US009714526B2

(12) United States Patent
Lai

(10) Patent No.: US 9,714,526 B2
(45) Date of Patent: Jul. 25, 2017

(54) CODE COMBINATION LOCK

(71) Applicant: YIFENG MANUFACTURING CO.,LTD., Dongguan (CN)

(72) Inventor: Leo Lai, Dongguan (CN)

(73) Assignee: YIFENG MANUFACTURING CO., LTD., Dongguan (CN)

( * ) Notice: Subject to any disclaimer, the term of this patent is extended or adjusted under 35 U.S.C. 154(b) by 0 days.

(21) Appl. No.: 14/914,613

(22) PCT Filed: Apr. 27, 2015

(86) PCT No.: PCT/CN2015/077546

§ 371 (c)(1),
(2) Date: Feb. 25, 2016

(87) PCT Pub. No.: WO2016/062052

PCT Pub. Date: Apr. 28, 2016

(65) Prior Publication Data

US 2016/0290008 A1 Oct. 6, 2016

(30) Foreign Application Priority Data

Oct. 21, 2014 (CN) ..... 2014 1 0560947

(51) Int. Cl.
*E05B 37/00* (2006.01)
*E05B 37/20* (2006.01)
(Continued)

(52) U.S. Cl.
CPC ..... *E05B 37/0034* (2013.01); *E05B 37/12* (2013.01); *E05B 37/16* (2013.01); *E05B 37/20* (2013.01); *E05B 65/52* (2013.01)

(58) Field of Classification Search
CPC ..... E05B 37/00; E05B 37/12; E05B 37/16; E05B 37/0034; E05B 37/20; E05B 65/52
(Continued)

(56) References Cited

U.S. PATENT DOCUMENTS 3,294,206 A * 12/1966 Gehrie ..... E05B 65/52 190/121
4,462,232 A * 7/1984 Yang ..... E05B 37/12 70/312

(Continued)

FOREIGN PATENT DOCUMENTS

CN 104265091 A 1/2015
WO WO 2008116251 A1 * 10/2008 ..... A45C 5/03

*Primary Examiner* — Suzanne Barrett
(74) *Attorney, Agent, or Firm* — Ming Chow; Sinorica, LLC

(57) ABSTRACT

A code combination lock comprises a lock body whereto a first latch hook and a second latch hook are connected, a first catch 18 fixed in the first opening direction of the case, a second catch 19 fixed in the second opening direction of the case. When locked, the first latch hook engages with the first catch and the second latch hook engages with the second catch. The code combination lock further comprises a push module, a drive module, a lock blade and a code module. The code module is arranged to push the lock blade to fix or unfix the push module such that the push module could push the drive module to lock/unlock. With this kind of code combination lock, one can lock/unlock without having to put in code repeatedly.

10 Claims, 6 Drawing Sheets

(51) Int. Cl.

| | |
|---|---|
| ***E05B 65/52*** | (2006.01) |
| ***E05B 37/12*** | (2006.01) |
| ***E05B 37/16*** | (2006.01) |

(58) Field of Classification Search
USPC ..... 70/21, 312, 67, 69–71, 285, 286
See application file for complete search history.

(56) References Cited

U.S. PATENT DOCUMENTS

| | | | | |
|---|---|---|---|---|
| 2006/0248930 | A1* | 11/2006 | Elles | A45C 13/1084 70/71 |
| 2015/0040622 | A1* | 2/2015 | Meersschaert | E05B 35/105 70/69 |
| 2015/0252591 | A1* | 9/2015 | Roatis | E05B 37/00 70/277 |
| 2016/0222697 | A1* | 8/2016 | Lai | E05B 65/52 |
| 2016/0290008 | A1* | 10/2016 | Lai | E05B 37/20 |

* cited by examiner

CODE COMBINATION LOCK

FIELD OF THE INVENTION

This invention relates generally to locking apparatus and related technique, more specifically, this invention relates to a code combination lock.

BACKGROUND OF THE INVENTION

Lock is one of necessary items in people's everyday life for its importance in the security systems. However, most conventional locks could be locked only in one direction, thus, when there is a need to lock multi-stories' case/box/drawer, people have to install more than one conventional locks. Moreover, people have to input correct code every time for unlocking conventional code combination locks, which further adds to the inconvenience for use when there is a need to repeatedly lock/unlock the code combination lock.

SUMMARY OF THE INVENTION

The present invention aims to solve aforementioned inconvenience problems when using conventional locks, and proposes a code combination lock which may be locked in two directions and may be locked/unlocked without inputting correct code. Locks according to this invention are also easy to use and simple in structure.

The invention is implemented as following:

A code combination lock is provided. Said code combination lock includes a lock body, a first catch fixed in the first opening direction of the case, a second catch fixed in the second opening direction of the case. Said lock body includes a base and a housing fixed on the base, and there exists a housing space between the housing and base. Said base includes a first latch hook and a second latch hook, both of which are pivotally connected to the base. When locked, the first latch hook engages with the first catch and the second latch hook engages with the second latch hook. The code combination lock further includes a push module, a drive module, a lock blade and a code module.

Wherein, push module includes a first push unit and second push unit, said first push unit and second push unit are arranged on the opposite ends of the housing and are slidably connected thereto.

Wherein, drive unit comprises a first lock block and a second lock block, both of which are pivotally connected to the base. The first push unit may engage with the first lock block and push it to rotate while the second push unit may engage with the second lock block and push it to rotate. When locked, the first lock block engages with the first latch hook and the second lock block engages with the second latch hook.

Wherein, lock blade is arranged inside the housing space and is slidably connected to base. Lock blade includes a first limiting projection and a second limiting projection. When locked, the first limiting projection engages with the first push unit and the second limiting projection engages with the second push unit.

Wherein, code module may engage with lock blade and push it to slide back and forth along the base.

Wherein, a first push lever is arranged at bottom of the push unit, and a second push lever is arranged at bottom of the push unit. The first push lever may engage with the first lock block and push it to rotate while the second push lever may engage with the second lock block and push it to rotate.

Wherein, a first pad block and a second pad block are arranged between lock blade and base. The first push lever passes through the first hole on the first pad block and could be able to slide along the first hole while the second push lever passes through the second hole on the second pad block and could be able to slide along the second hole.

Wherein, both of the first lock block and the second lock block are provided with a first inclining surface and a second inclining surface. The first push lever may engage with the first inclining surface of the first lock block and push the first lock block to rotate while the second push lever may engage with the second inclining surface of the second lock block and push the second lock block to rotate. When locked, the second inclining surface of the first lock block would engage with the third inclining surface of the first latch hook while the second inclining surface of the second lock block would engage with the fourth inclining surface of the second latch hook 4.

Wherein, inside the push unit there is a key hole to which a lock cylinder is Pivotally connected and the first push lever is arranged at the bottom of the lock cylinder.

Wherein, a first limiting post is arranged close to the first pad block on the lock cylinder while a second limiting post is arranged on the push unit. When locked, the first limiting post will engage with the first limiting projection and the second limiting post will engage with the second limiting projection.

Wherein, both the first latch hook and the second latch hook are connected to the base with a knurled sleeve respectively. Inside the knurled sleeve a torsion spring may be arranged.

Wherein, code module includes a cover plate arranged in the housing space, a moving blade, a code ring and an adjustment ring engaged with the code ring. A positioning shaft is arranged on the cover plate in the housing space, the code ring and the adjustment ring are arranged on the positioning shaft in a top-to-bottom order. Adjustment ring comprises a groove which may engage with the projection on the moving blade. Moving blade engages with the lock blade and pushes it to move in a parallel direction, cover plate is fixed on the base and is arranged between lock blade and moving blade. Also, a return spring is arranged between cover plate and lock blade.

Wherein, there is a moving pushing block arranged on the moving blade while a limiting slot may be arranged on the cover plate, moving pushing block 112 engages with lock blade 9 through limiting slot 101.

Wherein, the code combination lock also includes an adjustment module which includes an adjustment switch arranged in the housing space. Specifically, adjustment switch is arranged between the cover plate and moving blade and the adjustment switch is slidably connected to cover plate. On the adjustment switch there is a push block which passes through the first limiting slot on the cover plate while a projection and a second limiting slot are arranged on the adjustment switch. Between the projection and the second limiting slot there is a sliding guide through which the adjustment ring would be able to slide. There is also an adjustment spring arranged between the code ring and the adjustment ring. When setting up a new code, the bottom of the adjustment ring engages with the second limiting slot.

In this invention, a code combination lock is disclosed. When locked, code module pushed the lock blade to move to the right such that limiting projection engages with the first push unit and limiting projection engages with the second push unit to fix the first push unit and the second push unit respectively. Then the first push unit engages with the first lock block to engage the first lock block with the first latch hook and the second push unit engages with the second lock block to engage the first lock block with the first latch hook. Then the first latch hook engages with the first catch and the second latch hook engages with the second catch and the multi-story case is locked in two directions. When unlocking, the code module will push the lock blade to move to the left such that the first limiting projection disengages with the first push unit and the second limiting projection disengages with the second push unit to unfix the first push unit and the second push unit. The push the first push unit and the second push unit to slide to the opposite direction such that the first push unit engages with the first lock blade to push it to rotate to disengage with the first latch hook and the second push unit engages with the second lock blade to push it to rotate to disengage with the second latch hook. Then the first latch hook will disengage with the first catch and the second latch hook will disengage with the second catch, and the unlocking process is completed. When the code combination lock is in unlocked status, push the first push unit and the second push unit accordingly one would be able to lock/unlock temporally without having to input a code.

BRIEF DESCRIPTION OF THE DRAWINGS

While drawings are provided for detailed explanation of present invention, present invention is not limited to the drawings.

DESCRIPTION OF THE PREFERRED EMBODIMENTS

Figure 1:
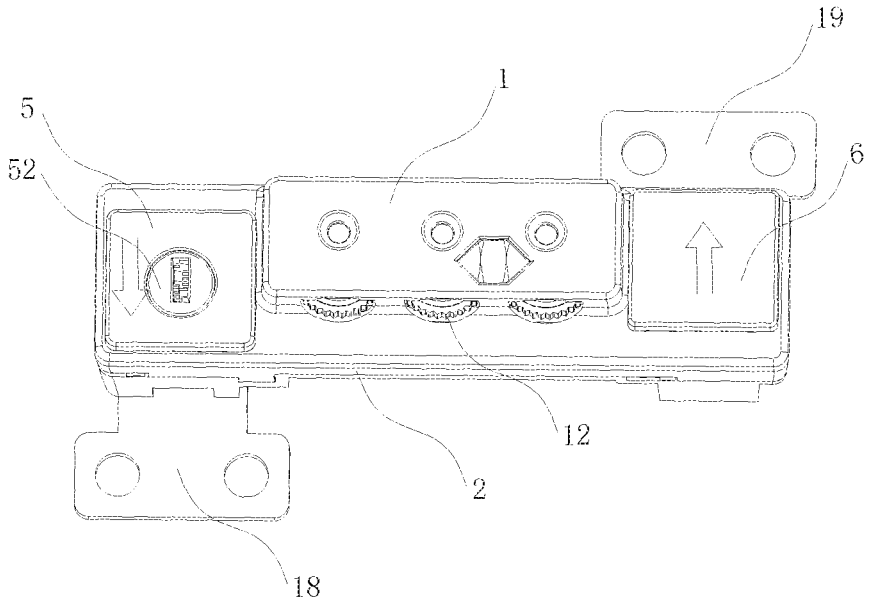
FIG. 1 is a structural diagram of a code combination lock.
Figure 2:
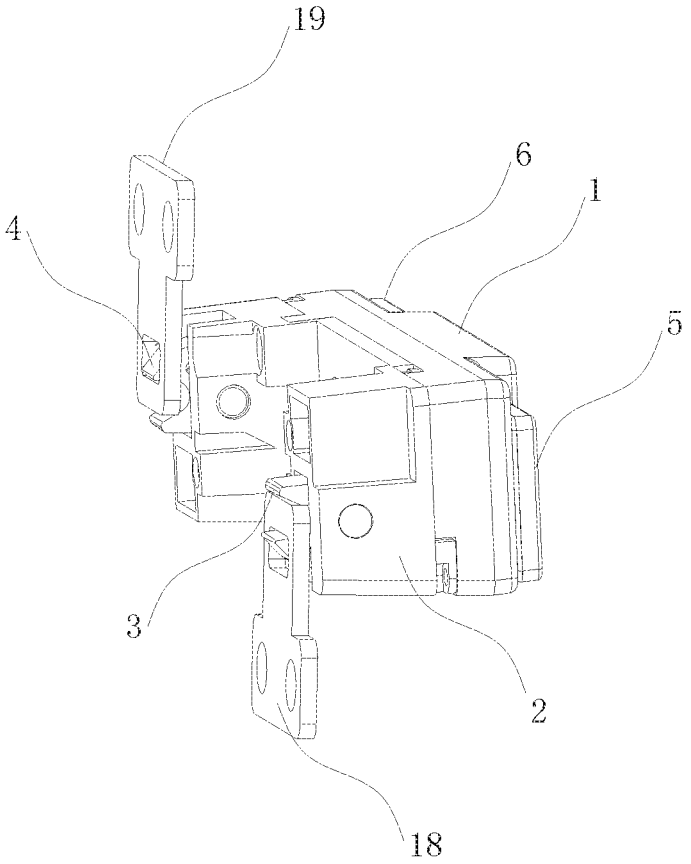
FIG. 2 is the structural diagram of a code combination lock from another perspective.
Figure 3:
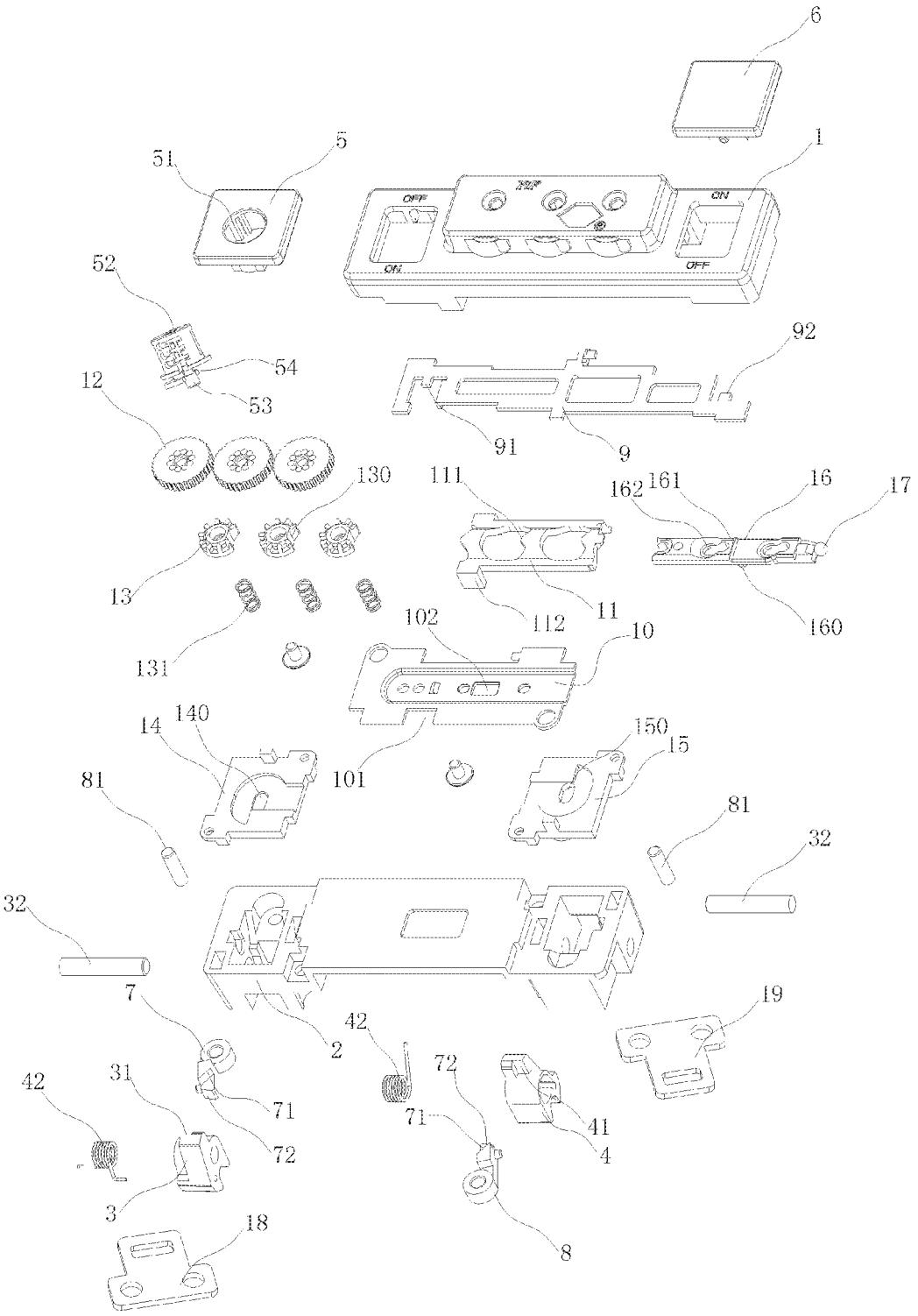
FIG. 3 is a exploded view of the code combination lock.

A detailed description of present invention is provided below with accompanying figures.

As shown in FIGS. 1-6, a code combination lock according to present invention includes a lock body, a first catch 18 fixed in the first opening direction of the case, a second catch 19 fixed in the second opening direction of the case. The said lock body includes a base 2 and a housing 1 fixed on the base, and there exists a housing space between the housing 1 and base 2. Said base 2 includes a first latch hook 3 and a second latch hook 4, both of which are pivotally connected to the base 2. When locked, the first latch hook 3 engages with the first catch 18 and the second latch hook 4 engages with the second latch hook 19.

Specifically, the first latch hook 3 and the second latch hook 4 are pivotally connected to the base 2 with a knurled sleeve 32 inside which there is provided a torsion spring 42. The torsion spring 42 will be twisted when the first latch hook 3 engages with the first catch 3 and/or the second latch hook 4 engages with the second latch hook 19.

In this embodiment, the code combination lock further includes a push module, a drive module, a lock blade 9 and a code module.

Push module includes a first push unit 5 and a second push unit 6, said first push unit 5 and second push unit 5 are arranged on the opposite ends of the housing 1 and are slidably connected thereto.

Specifically, a first push lever 53 is arranged at bottom of the push unit 5, and second push lever 61 is arranged at bottom of the push unit 6.

Figure 5:
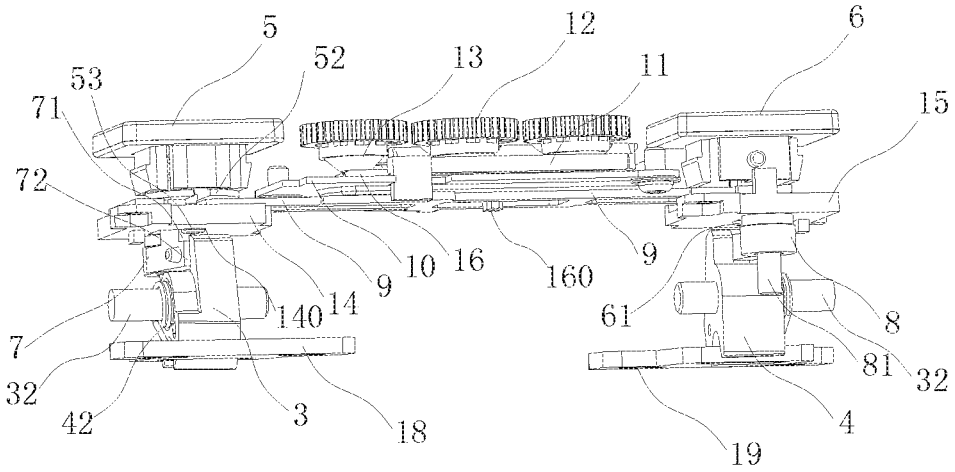
FIG. 5 is the structural diagram of the code combination lock with housing and base being hidden.

As shown in FIG. 5, drive unit comprises a first lock block 7 and a second lock block 8, both of which are provided with a first inclining surface 71 and a second inclining surface 72 and are pivotally connected to the base 2 with a second knurled sleeve 81. The first push lever 53 may engage with the first inclining surface 71 of the first lock block 7 and push the first lock block 7 to rotate while the second push lever 61 may engage with the first inclining surface 71 of the second lock block 8 and push the second lock block 8 to rotate. When locked, the second inclining surface 72 of the first lock block 7 would engage with the third inclining surface 31 of the first latch hook 3 while the second inclining surface 72 of the second lock block 8 would engage with the fourth inclining surface 41 of the second latch hook 4, thus the first latch hook 3 would engage with first catch 18 and the second latch hook 4 would engage with the second catch 19. When unlocked, the second inclining surface 72 of the first lock block 7 disengages with the third inclining surface 31 of the first latch hook 3 while the second inclining surface 72 of the second lock block 8 disengages with the fourth inclining surface 41 of the second latch hook 4, then the first latch hook 3 and second latch hook 4 may be rotated by twisted torsion spring 42, thus the first latch hook 3 will disengage with first catch 18 and second latch hook 4 will disengage with second catch 19.

Figure 4:
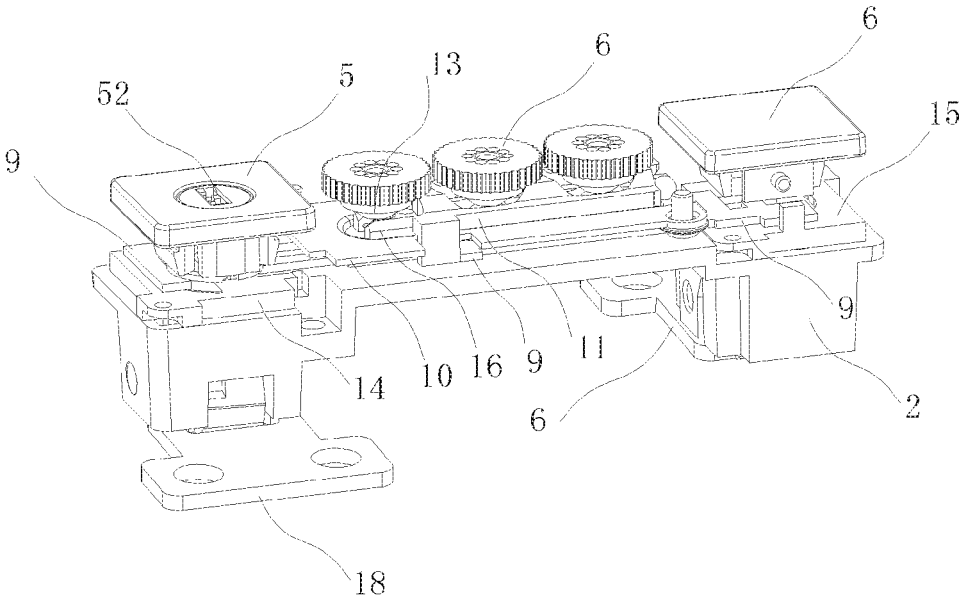
FIG. 4 is the structural diagram of the code combination lock with housing being hidden.
Figure 6:
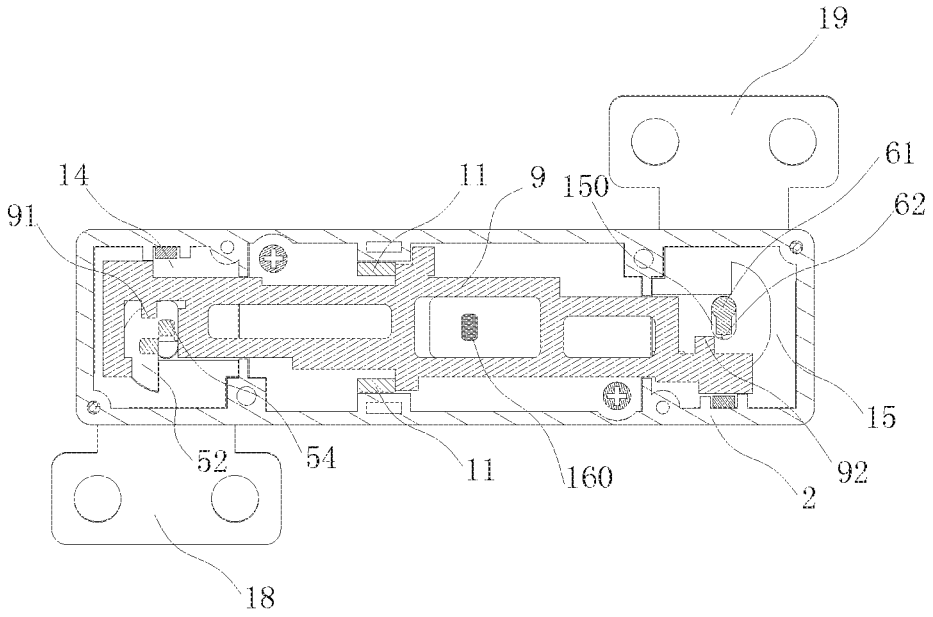
FIG. 6 is a sectional view of the code combination lock.

As shown in FIGS. 4-6, a lock blade 9 is arranged inside the housing space and is slidably connected to base 2. Lock blade 9 includes a first limiting projection 91 and a second limiting projection 92. When locked, the first limiting projection 91 engages with the first push unit 5 and the second limiting projection 92 engages with the second push unit 6 and in this way the first push unit 5 and the second push unit 6 are fixed to firmly fix the first latch hook 3 and the second latch hook 4.

As shown in FIG. 4, code module may engage with lock blade 9 and push it to slide along base 2.

Specifically, code module includes a cover plate 10 arranged in the housing space, a moving blade 11, a code ring 12 and an adjustment ring 13 engaged with the code ring 12. A positioning shaft is arranged on the cover plate 10 in the housing space, code ring 12 and adjustment ring 13 are arranged on the shaft in a top-to-bottom order. Adjustment ring 13 comprises a groove 130 which may engage with the projection 111 on the moving blade 11. Moving blade 11 engages with lock blade 9 and pushes it to move in a parallel direction, cover plate 10 is fixed on the base and is arranged between lock blade 9 and moving blade 11. Also, a return spring is arranged between plate 10 and lock blade 9.

When locking the case, the first catch 18 and the second catch 19 arranged in different opening direction of the case respectively are pressed to engage with the first latch hook 3 and the second latch hook 4 respectively, and at this time, one can rotate the code ring 12 to input an incorrect code so the code ring 12 would rotate the adjustment ring 13 which would in turn push the moving blade 11 to move to the right, and the moving blade 11 would in turn push the lock blade 9 to move to the right. With the lock blade 9 moving to the right, limiting projection 91 engages with first push unit 5 and limiting projection 92 engages with second push unit 6 to fix the first push unit 5 and second push unit 6 respectively while the first push lever 53 engages with the first inclining surface 71 of the first lock block 7 and second push lever 61 engages with the second inclining surface 71 of the second lock block 8 to force the second inclining surface 72 of the first lock block 7 to engage with the third inclining surface 31 of the first latch hook 3 and the second inclining surface 72 of the second lock block 8 to engage with the fourth inclining surface 41 of the second latch hook 4. Thus, the first latch hook 3 and the second latch hook 4 are prevented from rotation, and the lock is firm, reliable for use. Also, present code combination lock could be able to lock the case from upper side and lower side as show in Figs (i.e. in two direction), so it is convenient for use. When unlocking, one needs to rotate the code ring 12 to input the correct code to rotate the adjustment ring 13 to push moving blade 11 to move to the left and moving blade 11 would in turn push the lock blade 9 to move to the left. With the lock blade 9 moving to the left, the first limiting projection 91 disengages with first push unit 5 and limiting projection 92 disengages with second push unit 6 to unfix the first push unit 5 and second push unit 6 respectively. Then push the first push unit 5 to the upper side and the second push unit 6 to the lower side as indicated by the arrow in FIG. 1 and the first push lever 53 will push the first lock block 7 to rotate and the second push lever 61 will push the second lock block 8 to rotate, thus, the second inclining surface 72 of the first lock block 7 would disengage with the third inclining surface 31 of the third latch hook 3 and the second inclining surface 72 of the second lock block 8 will disengage with the fourth inclining surface 41 of the second latch hook 4. Then the first latch hook 3 and the second latch hook 4 will be rotated by the torsion spring 42, with so, the first latch hook 3 would disengage with first catch 18 and the second latch hook 4 would disengage with the second catch 19 and the case would be unlocked and could be opened at this time. When one inputs correct code at first, one could easily lock/unlock the case by pushing the push unit 5 and push unit 6 to move accordingly to the upper side or lower side. So people could easily lock/unlock without having to input code every time.

In present embodiment, a first pad block 14 and a second pad block 15 are arranged between lock blade 9 and base 2. The first push lever 53 passes through the first hole 140 on the first pad block 14 and could be able to slide along the first hole 140 while the second push lever 61 passes through the second hole 150 on the second pad block and could be able to slide along the second hole 150.

In case people forget their codes, one could unlock present code combination lock using a key. Inside the push unit 5 there is a key hole 51 to which a lock cylinder 52 is pivotally connected. The bottom of the lock cylinder 52 is pivotally connected to and engaged with lock blade 9 while the first push lever 53 is arranged at the bottom of the lock cylinder 52. Insert the key into the lock cylinder 52 and turn it to push the lock blade 9 to move to the left, thus the first limiting projection 91 will disengage with the first push unit 5 and the second limiting projection 92 will disengage with the second push unit 6. Then one can push the first push unit 5 and the second push unit 6 to unlock without inputting correct code.

Specifically, a first limiting post 54 is arranged close to the first pad block 14 on the lock cylinder 52 while a second limiting post 62 is arranged on the push unit 6. When locked, the first limiting post 54 would engage with the first limiting projection 91 and the second limiting post 62 would engage with the second limiting projection 92.

More specifically, there is a moving pushing block 112 arranged on the moving blade 11 while a limiting slot 101 is arranged on the cover plate 10. The moving pushing block 112 is arranged to be able to engage with lock blade 9 through limiting slot 101 so that it would be pushed to push the lock blade 9 when locked. When unlocked, the spring between the cover plate 10 and lock blade 9 would pull the lock blade 9 to move to the left.

In the present invention , the code combination lock also includes an adjustment module which includes an adjustment switch 16 arranged in the housing space and a steel ball 17. Adjustment switch 16 is arranged between the cover plate 10 and moving blade 11 and the adjustment switch 16 is slidably connected to cover plate 10. On the adjustment switch 16 there is a push block 160 which passes through the first limiting s1ot102 on the cover plate 10 while a projection 161 and a second limiting slot 162 are arranged on the adjustment switch 16. Between the projection 161 and the second limiting slot 162 there is a sliding guide through which the adjustment ring 13 would be able to slide. There is also an adjustment spring 131 arranged between the code ring 12 and adjustment ring 13. When locked or unlocked, the projection 161 will engage with adjustment ring 13. When we need to set up a new code, we may push the push block 160 on the adjustment switch 16 to push the adjustment switch 16 to move to the right along the cover plate 10 while the right inclining surface of the adjustment switch 16 will push the steel ball 17 to move to the upside along the inner wall of housing 1. And the steel ball 17 will exert a force on the moving blade 11 such that the projection 111 will engage with adjustment ring 13 while the bottom of the adjustment ring 13 engages with the second limiting slot 162 to prevent possible misalignment of the adjustment ring 13 and code ring 12, thus it will be more stable to change the code.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed is:

1. A code combination lock, comprising:

a lock body, a first catch fixed in the first opening direction of the case, a second catch fixed in the second opening direction of the case; said lock body includes a base and a housing fixed on the base, and there exists a housing space between the housing and the base; said base includes a first latch hook and a second latch hook, both of which are pivotally connected to the base; the code combination lock further includes a push module, a drive module, a lock blade and a code module;

wherein, push module includes a first push unit and second push unit, said first push unit and second push unit are arranged on the opposite ends of the housing and are slidably connected thereto;

wherein, drive unit comprises a first lock block and a second lock block, both of which are pivotally connected to the base; the first push unit may engage with the first lock block and push the first lock block to rotate while the second push unit may engage with the second lock block and push the second lock block to rotate;

wherein, the lock blade is arranged inside the housing space and is slidably connected to base; lock blade includes a first limiting projection and a second limiting projection;

wherein, code module may engage with lock blade and push the lock blade to slide back and forth along the base;

when locked, the first limiting projection engages with the first push unit and the second limiting projection engages with the second push unit such that the first lock block engages with the first latch hook and the second lock block engages with the second latch hook, then the first latch hook engages with the first catch and the second latch hook engages with the second catch.

2. The code combination lock of claim 1, further comprising:

a first push lever is arranged at bottom of the first push unit, and a second push lever is arranged at bottom of the second push unit; the first push lever may engage with the first lock block and push the first lock block to rotate while the second push lever may engage with the second lock block and push the second lock block to rotate.

3. The code combination lock of claim 2, further comprising:

a first pad block and a second pad block are arranged between lock blade and base; the first push lever passes through the first hole on the first pad block and could be able to slide along the first hole while the second push lever passes through the second hole on the second pad block and could be able to slide along the second hole.

4. The code combination lock of claim 2, further comprising:

both of the first lock block and the second lock block are provided with a first inclining surface and a second inclining surface; the first push lever may engage with the first inclining surface of the first lock block and push the first lock block to rotate while the second push lever may engage with the second inclining surface of the second lock block and push the second lock block to rotate; when locked, the second inclining surface of the first lock block would engage with the third inclining surface of the first latch hook while the second inclining surface of the second lock block would engage with the fourth inclining surface of the second latch hook.

5. The code combination lock of claim 3, further comprising:

inside the push unit there is a key hole to which a lock cylinder is pivotally connected and the first push lever is arranged at the bottom of the lock cylinder.

6. The code combination lock of claim 5, further comprising:

a first limiting post is arranged close to the first pad block on the lock cylinder while a second limiting post is arranged on the push unit; when locked, the first limiting post will engage with the first limiting projection and the second limiting post will engage with the second limiting projection.

7. The code combination lock of claim 1, further comprising:

both the first latch hook and the second latch hook are connected to the base with a knurled sleeve respectively; inside each knurled sleeve a torsion spring is arranged.

8. The code combination lock of claim 1, further comprising:

code module includes a cover plate arranged in the housing space, a moving blade, a code ring and an adjustment ring engaged with the code ring; a positioning shaft is arranged on the cover plate in the housing space, the code ring and the adjustment ring are arranged on the positioning shaft in a top-to-bottom order; adjustment ring comprises a groove which may engage with the projection on the moving blade; moving blade engages with the lock blade and push the lock blade to move in a parallel direction, cover plate is fixed on the base and is arranged between lock blade and moving blade; also, a return spring is arranged between cover plate and lock blade.

9. The code combination lock of claim 8, further comprising:

there is a moving pushing block arranged on the moving blade while a limiting slot is arranged on the cover plate, moving pushing block engages with lock blade through limiting slot.

10. The code combination lock of claim 8, further comprising:

An adjustment module which includes an adjustment switch arranged in the housing space; adjustment switch is arranged between the cover plate and moving blade and the adjustment switch is slidably connected to cover plate; on the adjustment switch there is a push block which passes through the first limiting slot on the cover plate while a projection and a second limiting slot are arranged on the adjustment switch; between the projection and the second limiting slot there is a sliding guide through which the adjustment ring would be able to slide; there is also an adjustment spring arranged between the code ring and the adjustment ring; when setting up a new code, the bottom of the adjustment ring engages with the second limiting slot.

* * * * *